United States Patent [19]

Pettigrew et al.

[11] Patent Number: 4,750,564

[45] Date of Patent: Jun. 14, 1988

[54] TUBING RESETTABLE WELL PACKER

[75] Inventors: Thomas L. Pettigrew, Bryan, Tex.; Charles L. Wright, Ratliff City, Okla.

[73] Assignee: Dresser Industries, Inc., Dallas, Tex.

[21] Appl. No.: 19,802

[22] Filed: Feb. 27, 1987

[51] Int. Cl.[4] ..... E21B 23/06; E21B 33/129

[52] U.S. Cl. ..... 166/387; 166/123; 166/134; 166/136; 166/382

[58] Field of Search ..... 166/387, 63, 123, 134, 166/136, 138, 140, 382, 214–217

[56] References Cited

U.S. PATENT DOCUMENTS

| | | | |
|---|---|---|---|
| 3,036,636 | 5/1962 | Clark, Jr. | 166/63 |
| 3,229,767 | 1/1966 | Carter | 166/134 |
| 3,393,742 | 7/1968 | Bigelow et al. | 166/123 |
| 3,749,166 | 7/1973 | Young | 166/134 X |
| 4,545,431 | 10/1985 | Fore | 166/134 X |
| 4,565,247 | 1/1986 | Tapp et al. | 166/123 |
| 4,593,765 | 6/1986 | Greenlee | 166/387 |
| 4,595,052 | 6/1986 | Kristiansen | 166/123 |
| 4,648,446 | 3/1987 | Fore et al. | 166/134 X |

*Primary Examiner*—Stephen J. Novosad
*Assistant Examiner*—Hoang C. Dang
*Attorney, Agent, or Firm*—Kanz, Scherback and Timmons

[57] ABSTRACT

A tubing string resettable packer is conditioned for initial wireline installation in a well utilizing an adapter within a mandrel carrying the slip assembly of the packer and frangible connecting means between the sealing assembly and mandrel to place the sealing assembly in an alternate transport condition for first being set by means of a wireline device. Thereafter, the tubing string may be connected to the packer downhole to release the packer for resetting in a different position.

12 Claims, 8 Drawing Sheets

TUBING RESETTABLE WELL PACKER

TECHNICAL FIELD

This invention relates to a well packer and particularly, a production packer which may be set downhole, released and moved to a new position, and reset without having to pull the tubing string to redress the packer.

BACKGROUND ART

In one example of a prior art well tool, a bridge plug carried on the end of the tubing string may be anchored to the casing of the well in a selected downhole position to isolate the zone in the well below the tool from the zone above the tool for the performance of a well service operation, such as acidizing, formation fracturing or pressure containment. Because a particular well may require that such operations be carried out at different locations within the well, it is desirable that the tool have the ability to be moved from location to location without having to pull the tubing string from the well to redress the tool. In one form of bridge plug currently available, a tubular mandrel is connected to the lower end of the tubing string and mounted on the mandrel is a slip assembly and sealing unit. Connected to the slip assembly is an anchor cage or reaction member which typically engages the inside surface of the casing so that relative motion between the slip assembly and the mandrel may be obtained by manipulation of tubing string. Typically, the manipulation of the tubing string includes both rotational movement in clockwise and counterclockwise directions as well as movement axially relative to the casing in either direction within the well. Combinations of rotational or axial movement may be utilized in the tool to cause slips in the slip assembly to be set against the well casing to anchor the tool in a selected position, and also to release the tool from that position for subsequent resetting at another location.

In another type of well tool, the wireline retrievable bridge plug, the tool may be lowered into position in the well on a wireline and set, such as by means of a wireline setting gun. The wireline tool, however, lacks the ability to be released and reset within the well without having to be pulled from the well for redressing purposes. However, advantages do exist in that lighter duty equipment may be used at the well head for conducting wireline operations as opposed to heavy duty workover rigs or production rigs that are necessary to provide support for the heavier well tubing.

U.S. Pat. No. 4,593,765 issued on June 10, 1986, illustrates a bridge plug that combines both of the foregoing features. The bridge plug described therein is initially set on a wireline and may subsequently be released and reset using tubing.

DISCLOSURE OF THE INVENTION

The primary aim of the present invention is to provide an improved production packer which may be set in a well by means of a wireline setting device, and which thereafter, may be released and reset at another location within the well without having to retrieve the packer from the well for redressing purposes. More specifically, the present invention contemplates the provision of a unique adapter along with locator means to releasably support the slip assembly of the packer in an alternate position for transporting the packer downhole by wireline and enabling the packer to be set by actuation of a wireline setting device. Thereafter, with the wireline device removed from the packer, production tubing or the like may be connected to the packer downhole and the packer released and reset in another position for additional well servicing.

The invention also resides in the unique construction of the adapter.

These and other advantages and features of the present invention will become more apparent from the following drawings when taken in conjunction with the best mode of carrying out the invention.

BEST MODE OF CARRYING OUT THE INVENTION

Figure 3A:
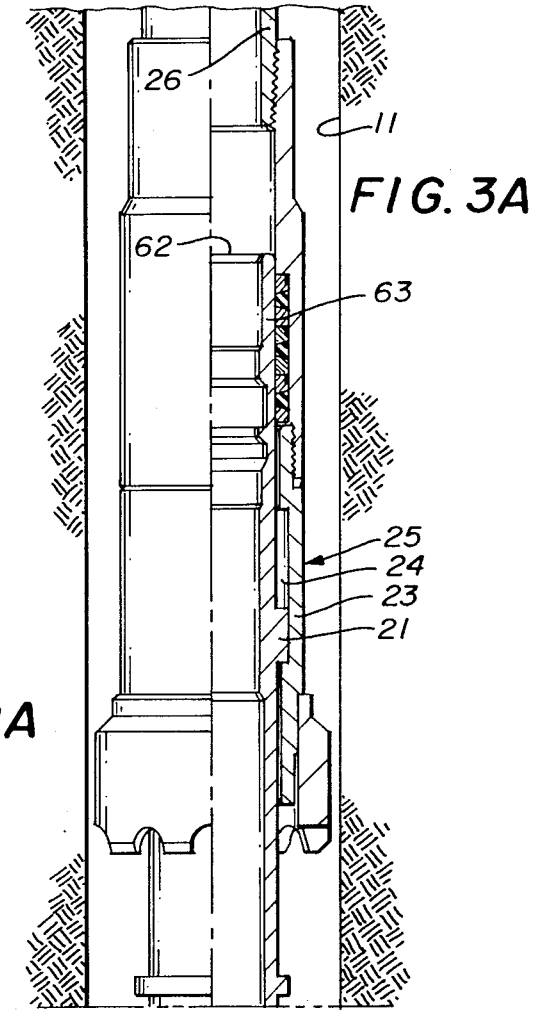
FIGS. 3A through 3F collectively represent a combined cross-sectional and elevational view of the packer in condition for movement vertically within the well for resetting by manipulation of a tubing string carrying the packer.
Figure 2A:
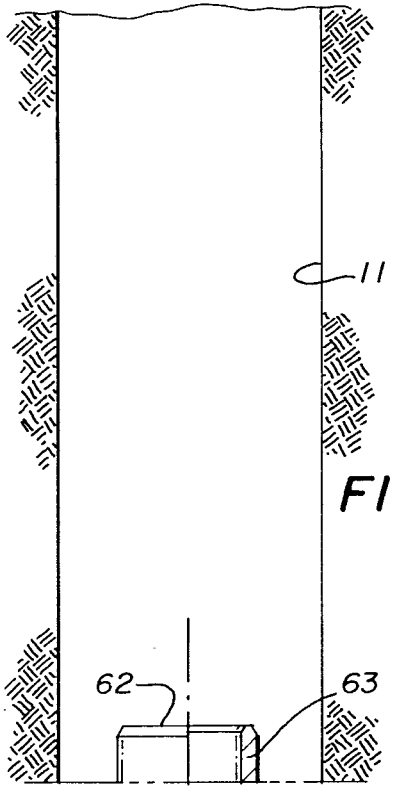
FIGS. 2A through 2F collectively represent a combined cross-sectional and elevational view of the packer installed in a well.
Figure 3B:
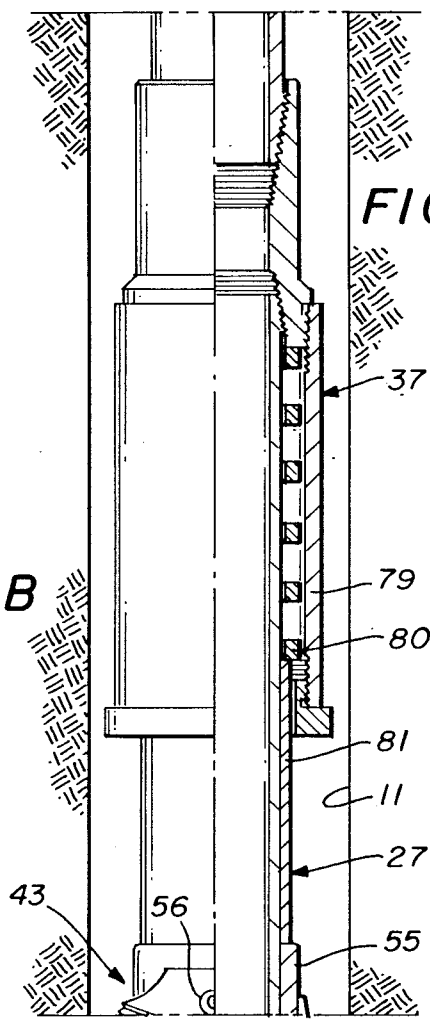
Figure 2B:
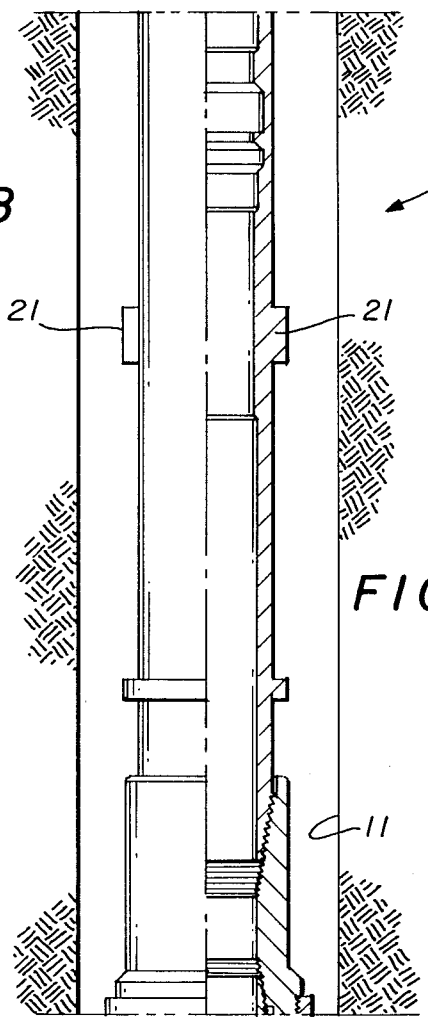
Figure 3C:
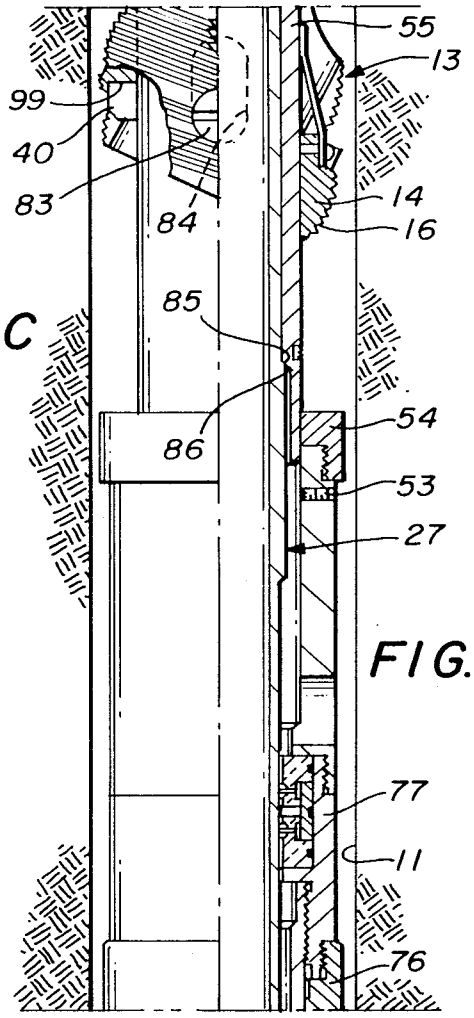
Figure 2C:
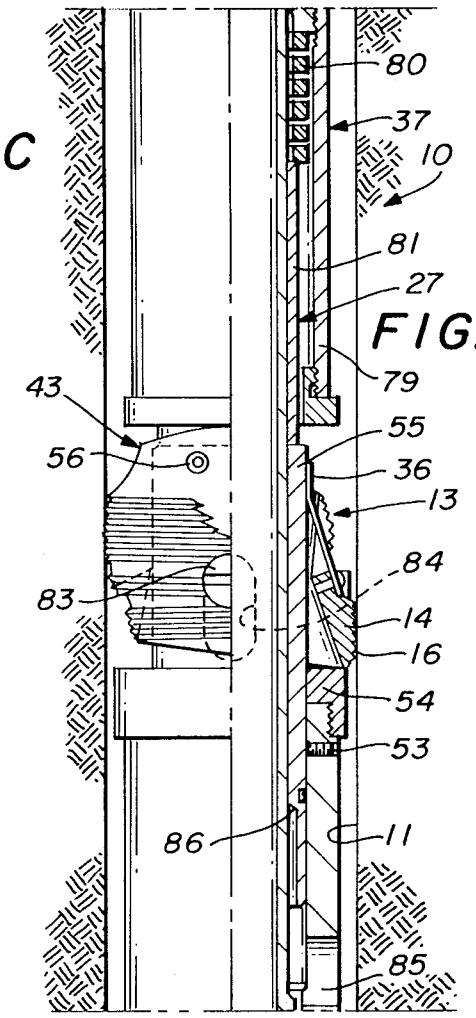
Figure 3D:
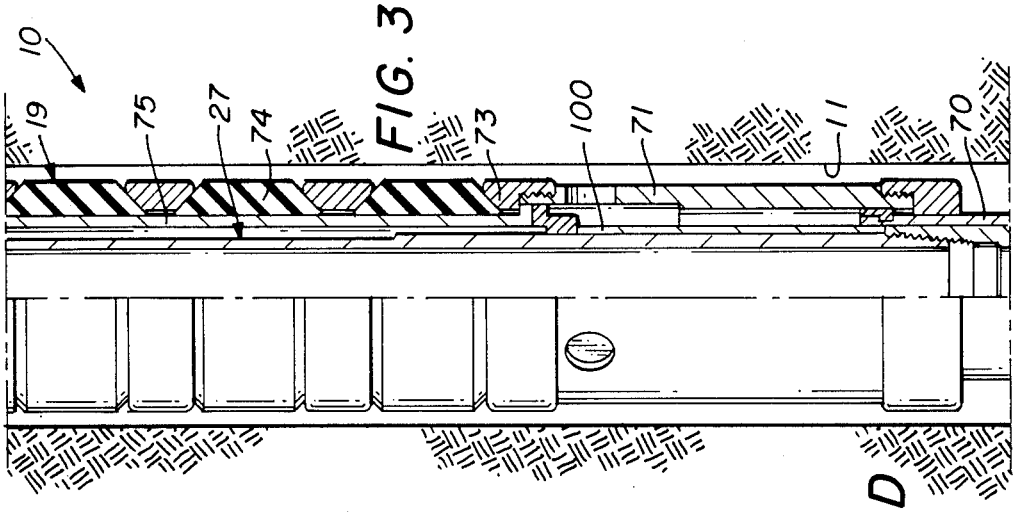
Figure 2D:
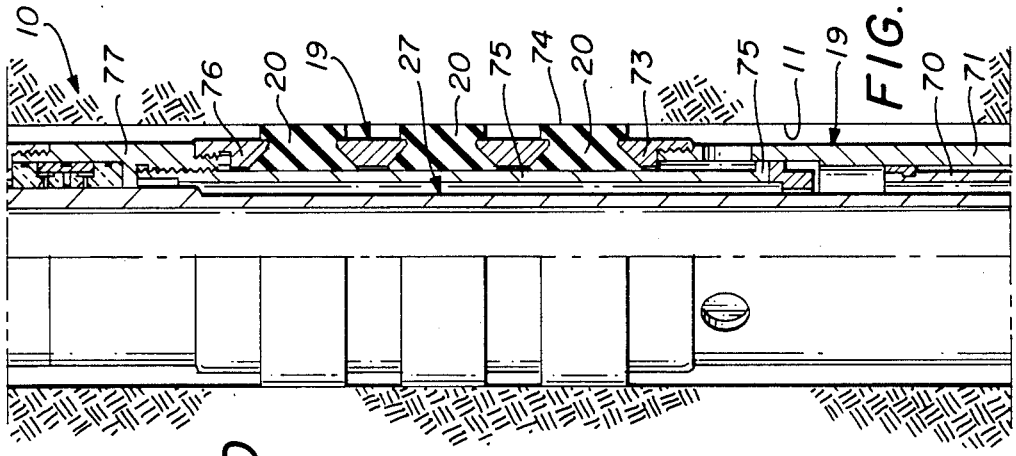

As shown in the drawings for purposes of illustration, the present invention is embodied in a retrievable production packer 10 such as may be used at various selected downhole positions in a well to isolate the zone of the well below the packer from the zone above it and to permit flow therethrough when desired In the combined FIGS. 2A through 2F, the packer 10 is shown as being anchored to the inside surface of casing 11 in the well by means of a bi-directional slip assembly 13, which includes a pair of upper and lower slip elements 14 and 15. As shown particularly in FIG. 2C, the upper slip element 14 is provided with an outer surface having teeth 16 formed therein to bite into the inside surface of the well casing and thereby anchor the packer 10 against being pulled upwardly within the well. Similarly, the lower slip element 15 (FIG. 2E) includes an outer surface with teeth 17 formed therein to bite into the surface of the casing, but arranged to hold the packer against being pushed downwardly within the well. Compressed between the upper and lower slip elements 14 and 15 is a sealing unit 19 (FIG. 2D) including elastomeric seals 20 pressed against the surface of the casing to seal the annular area between the packer and the casing. At the upper end of the packer, coupling pins 21 extend radially outward to nest within a trap 23 of a connecting recess 24 in an on-off tool 25 (see FIG. 3A) carried on the end of a tubing string 26.

A general understanding of the tubing string manipulations involved in moving the packer 10 into position, setting the slip assembly 13 to anchor the packer in place, and releasing of the slip assembly for moving the packer to a different selected position in the well, may be obtained from the schematic illustrations shown in FIGS. 4A through 4D. First with reference to FIG. 4A, the packer 10 includes a mandrel 27 that extends through each of the upper and lower slip elements 14 and 15 of the bi-directional slip assembly 13. Resilient means 29 including the sealing unit 19 of the exemplary bridge plug is functionally disposed between the slip elements and located on the mandrel 27 for urging the slip elements 14 and 15 in a setting or extended direction against the well casing. Beneath the lower slip element 15 and connected to the mandrel 27 by way of connecting means 30 including a gudgeon pin 31 is a reaction member 33.

Figure 5:
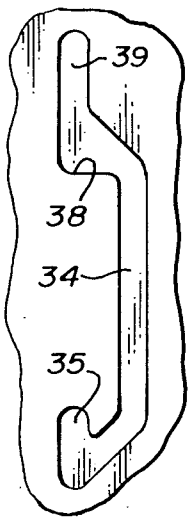
FIGS. 5 and 6 are enlarged fragmentary elevational views taking along the lines 5—5 and 6—6 from FIGS. 1E and F, and 1C and D respectively, with various parts of the packer being removed for clarity of illustration.
Figure 6:
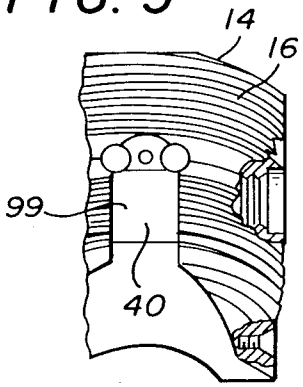

For operational purposes, the radially outward end of the gudgeon pin 31 is secured to the reaction member 33 while the opposite or inner end is free to ride within a J-slot 34 formed in the mandrel 27. In a transport condition for the packer, the reaction member 33 is disposed in a lower position relative to the mandrel 27 with the gudgeon pin 31 captured within a lower trap 35 of the J-slot 34 (see FIGS. 4A and 5). In this condition, the resilient means 29 is relatively undeformed and the upper and lower slip elements 14 and 15 are urged into retracted positions away from engagement with the well casing 11 by means of release urging springs 36.

Once the packer 10 is located at a desired position in the well, setting of the slip elements 14 and 15 is accomplished by first pulling up on the tubing string 26 and then rotating the tubing string 26 in a clockwise direction to shift the gudgeon pin 31 out of the lower trap 35 of the J-slot 34. Frictional engagement of the reaction member 33 with the inside wall of the casing 11 holds the gudgeon pin 31 in a relatively fixed position within the well so as to provide for the relative rotational movement between the J-slot 34 and the gudgeon pin 31 when the tubing string is rotated. Once the gudgeon pin 31 has been moved out of the lower trap 35, the mandrel 24 may be shifted downwardly relative to the reaction member 33 by setting down on the tubing string 26. This action causes resilient means 29 to engage the lower slip element 15 (see FIG. 4B) and to pivot it outwardly into an extended position for gripping the inside surface of the casing 11 thereby setting the lower slip 15. At the same time, setting stop means 37 on the mandrel 27 above the upper slip element 14 is shifted downwardly with the mandrel 27 and engages the upper slip element 14 causing it also to pivot outwardly into an extended position and set against the inside surface of the casing 11 as is shown also in FIG. 4B.

To complete setting of the slips and effectively deform the resilient means 29 between the slip elements 14 and 15, the tubing string 26 is lowered to locate the gudgeon pin 31 in an upper trap 39 of the J-slot 34. The tubing string 26 is then lifted, pulling the mandrel 27 upwardly until a shoulder 38 in the J-slot abuts the pin 31. Because the upper slip element 14 holds against movement in an upward direction and the lower slip element 15 holds against movement in a downward direction, upward movement of the tubing string 26 causes the lower slip element 15 to be lifted while the upper slip element 14 remains fixed in the casing so as to further deform the resilient means 29 between the two slip elements 14 and 15 to the extent desired to insure that the slip elements will remain effectively anchored in the casing 11. (See FIG. 4C.)

To release the slip assembly 13 from the set position, the mandrel 27 is lowered slightly shifting the pin 31 off the shoulder 38 while also applying torque in a clockwise direction to the tubing string 26. This shifts the gudgeon pin 31 to the release side of the upper trap 39 (see FIG. 4D) so that when the tubing string 26 thereafter is pulled upwardly while maintaining the torque, the mandrel 27 travels upwardly with the gudgeon pin 31 riding within the J-slot into the lower trap 35. As the mandrel 27 is lifted by pulling on the tubing string 26, slip disengaging means 40 in the form of a retrieving lug lifts the upper slip element 14 into its retracted position, releasing the forced applied to the resilient means 29, which returns to its undeformed condition. The gudgeon pin 31 bottoms out in the lower trap 35 and the lower slip element 15 moves into a release position by action of the release urging means 36 thereby completing the unsetting of the slip elements to free the tool 10 for resetting in another position in the well. The various parts have returned to the positions shown in FIG. 4A.

When first installing the exemplary packer 10 in a well within which servicing is to be performed at a later date, it is preferable that the packer be installed as quickly and inexpensively as possible. The present invention contemplates a unique method and apparatus to achieve this end for initial installation of the well packer by elimination of the need for using a tubing string in the initial installation, yet while leaving the packer in the well for later connection to the tubing string 26 so that the packer 10 may be repositioned within the well without the need of the packer being pulled out of the well for redressing purposes.

This is accomplished through the provision of adaptor 41 (see FIG. 1) and fastening means 43 for securing the slip assembly 13 including the connecting means 30 in an alternate transport condition so that the adaptor may be connected to a wireline setting device 44. The setting device 44 may be actuated to set the slip elements 14 and 15 downhole from a remote position at the well head. Advantageously then, the packer 10 may be installed quickly and inexpensively using lighter wireline equipment so that heavier duty workover or production rigs may be brought in at a later time and connected with the packer downhole to perform the well preparation or servicing operations.

The adaptor 41 comprises an elongated plug telescoped through the mandrel 27 and extending downwardly past the lower slip element 15 to an area within the mandrel 27 adjacent to a plug assembly 100 (see FIGS. 1A through 1F). At the lower end of the plug a shear stud connector 102 frangibly secures the adaptor 41 to the wireline setting device 44 and to the packer 10.

The shear stud connector 102 is screwed into a pump-out plug 104 that is located in the lower end of the plug assembly 100 and closes the bore through the packer 10. One or more shear screws 106 is provided to retain the pump-out plug 104 until such time as a pressure is increased in interior 108 of the plug assembly 100 that is sufficient to shear the screws 106. In order to seal the chamber interior 108 of the plug assembly 100, annular seals 110 and 112 are provided. It will be noted that the plug assembly 100 is connected to the lower end of the mandrel 27 and is movable therewith during the setting operations of the packer 10.

Figure 3F:
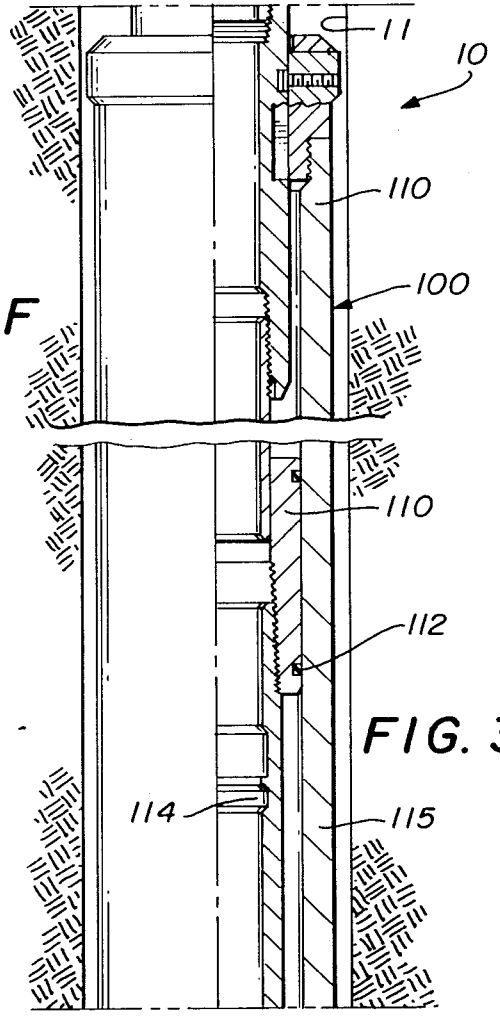
Figure 2F:
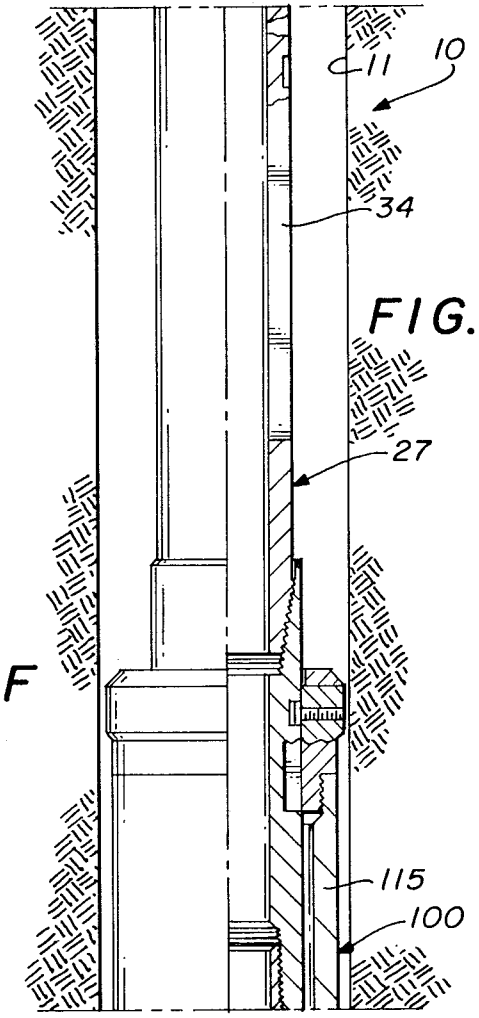

As may be more clearly seen in FIGS. 2F and 3F, plug receiving annular groove 114 is provided within the plug assembly 100. The groove 114 is utilized when it is desired to reclose the interior 108 and thus prevent flow through the packer 10 during certain subsequent treating operations in the well. A plug (not shown) is either pumped down or lowered through the tubing 26 until it lands in the groove 114 and thereby recloses the bore.

The wireline setting devices are well known in the art and are operated by means of an explosive charge (not shown) which is set off within a chamber in the device causing the simultaneous application of a force from the housing 46 of the device to the top of the packer 10 in the downward direction and an upward pulling force on the shear stud connector 102.

In the present arrangement, when the wireline setting device 44 is actuated, the adaptor 41 is pulled upwardly and the upper and lower slip elements 14 and 15 are shifted from their retracted positions to their extended positions to anchor against the well casing. At the same time the sealing unit 19 is deformed to seal against the inside surface of the well casing. As the setting forces become sufficiently high, the shear stud connector 102 breaks to complete the setting procedure and free the wireline setting device 44 from the packer 10 for retrieval to the head of the well.

As particularly shown in FIGS. 1C through 1F, the fastener means 43 provides for releasably supporting the slip assembly 13 and the sealing unit 19 relative to each other in an intial or alternate travel position. Herein, such means includes a lower shear screw 51 extending between the reaction member 33 and the mandrel 27 and a frangible screw 53 extending between a housing 54 of the sealing unit 19 and a tubular carrier 55 to which the upper slip 14 is pinned. Additionally, included is an upper shear screw 56 which secures the upper slip element 14 releasably on the slip carrier in the retracted position. Each of the screws 51, 53 and 56 are sheared as an incident to the initial setting of the slip assembly utilizing the wireline setting device 44, and once sheared, the packer 10 is conditioned to thereafter function as a tubing retrievable packer.

Figure 1A:
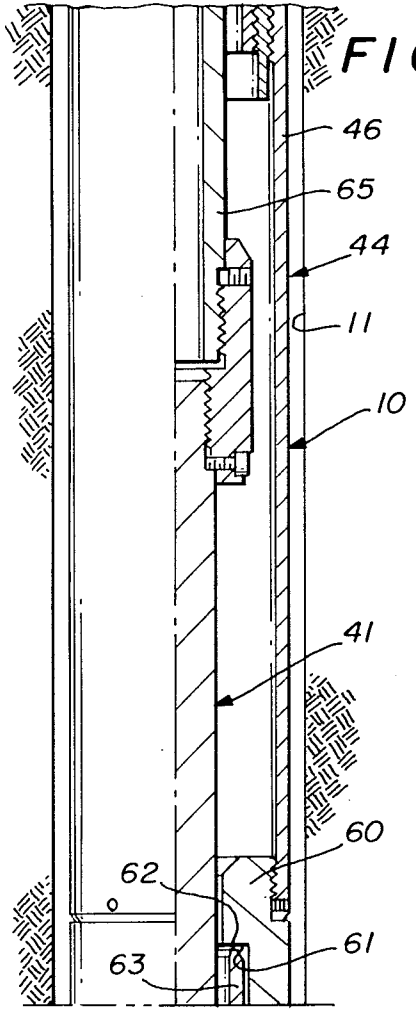
FIGS. 1A through 1F collectively represent a combined cross-sectional and elevational view of a well packer embodying the novel features of the present invention as the packer would be run into a well.
Figure 1B:
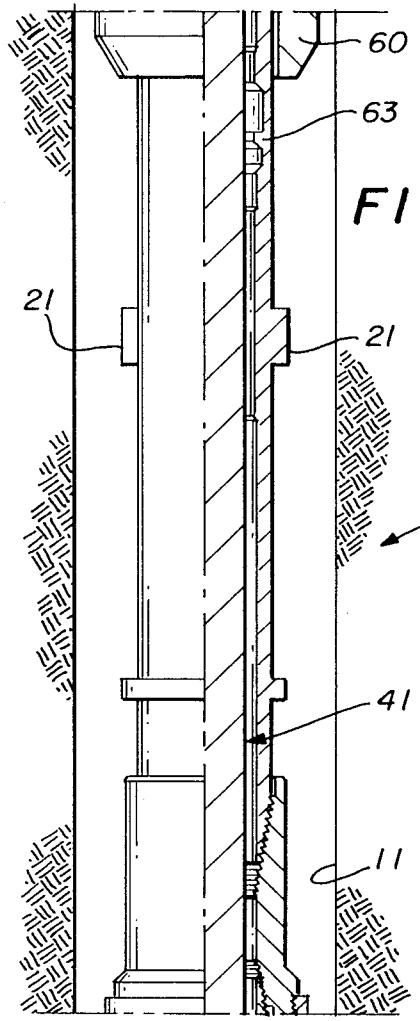
Figure 1C:
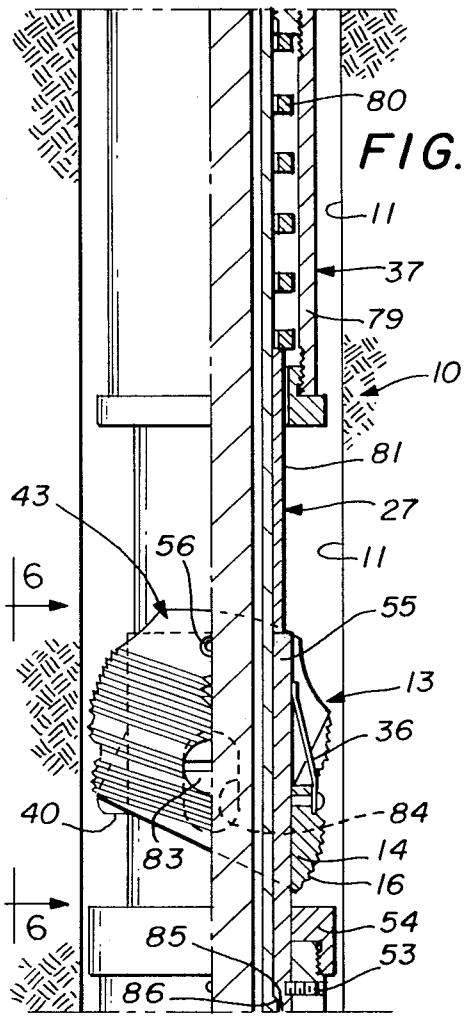
Figure 1D:
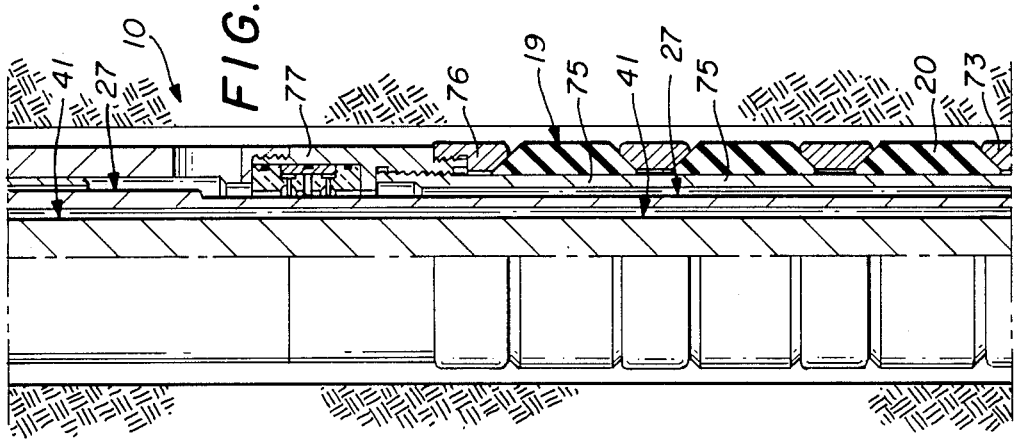
Figure 3E:
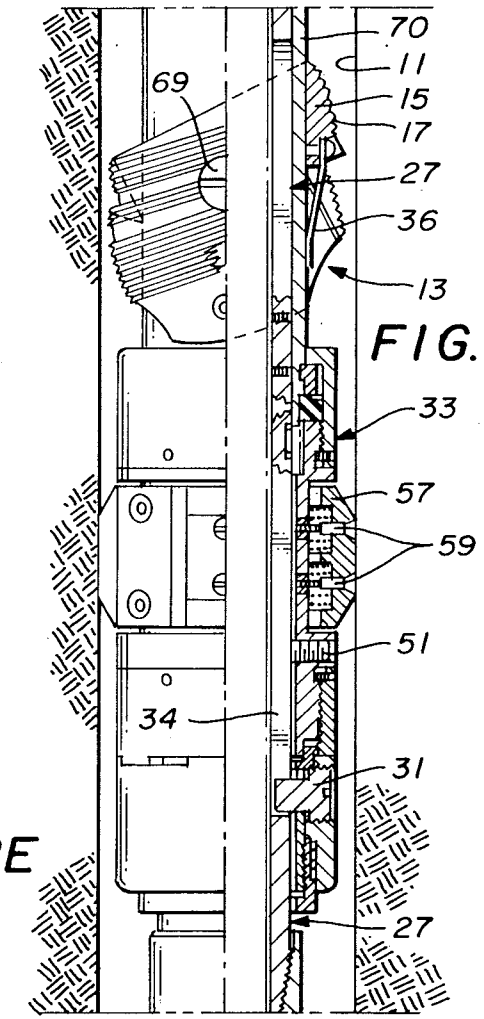
Figure 2E:
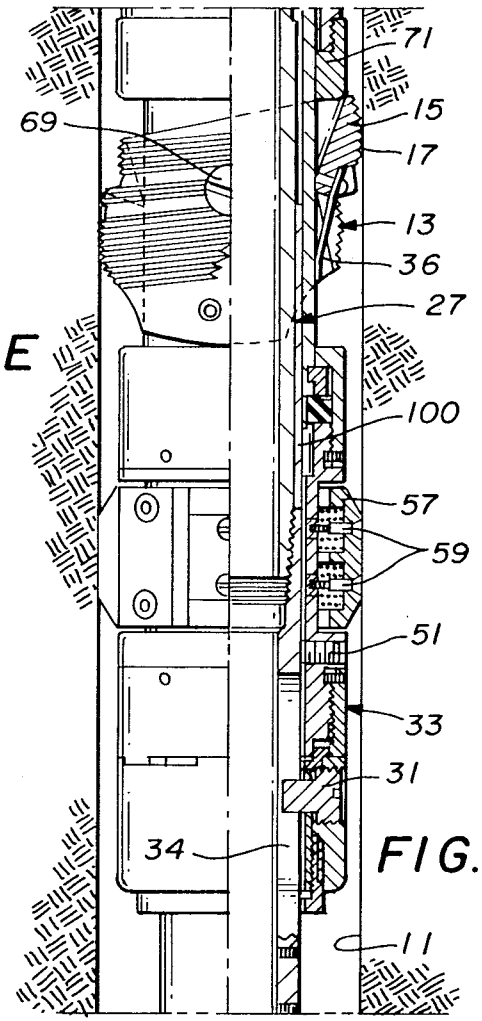
Figure 1E:
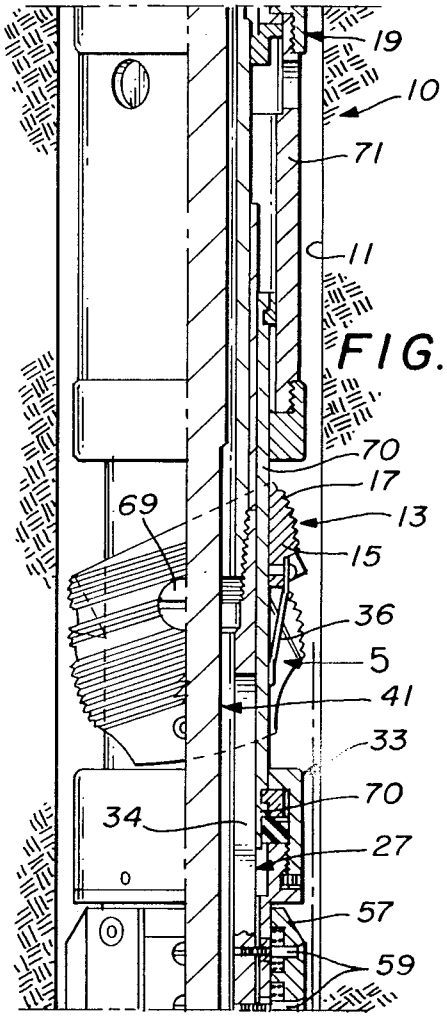
Figure 1F:
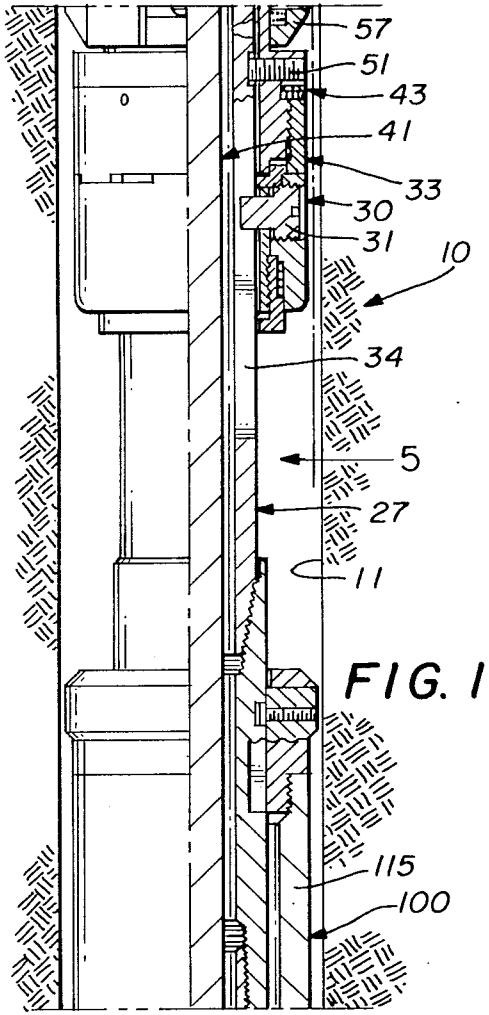
Figures 1G, 2G, 3G:
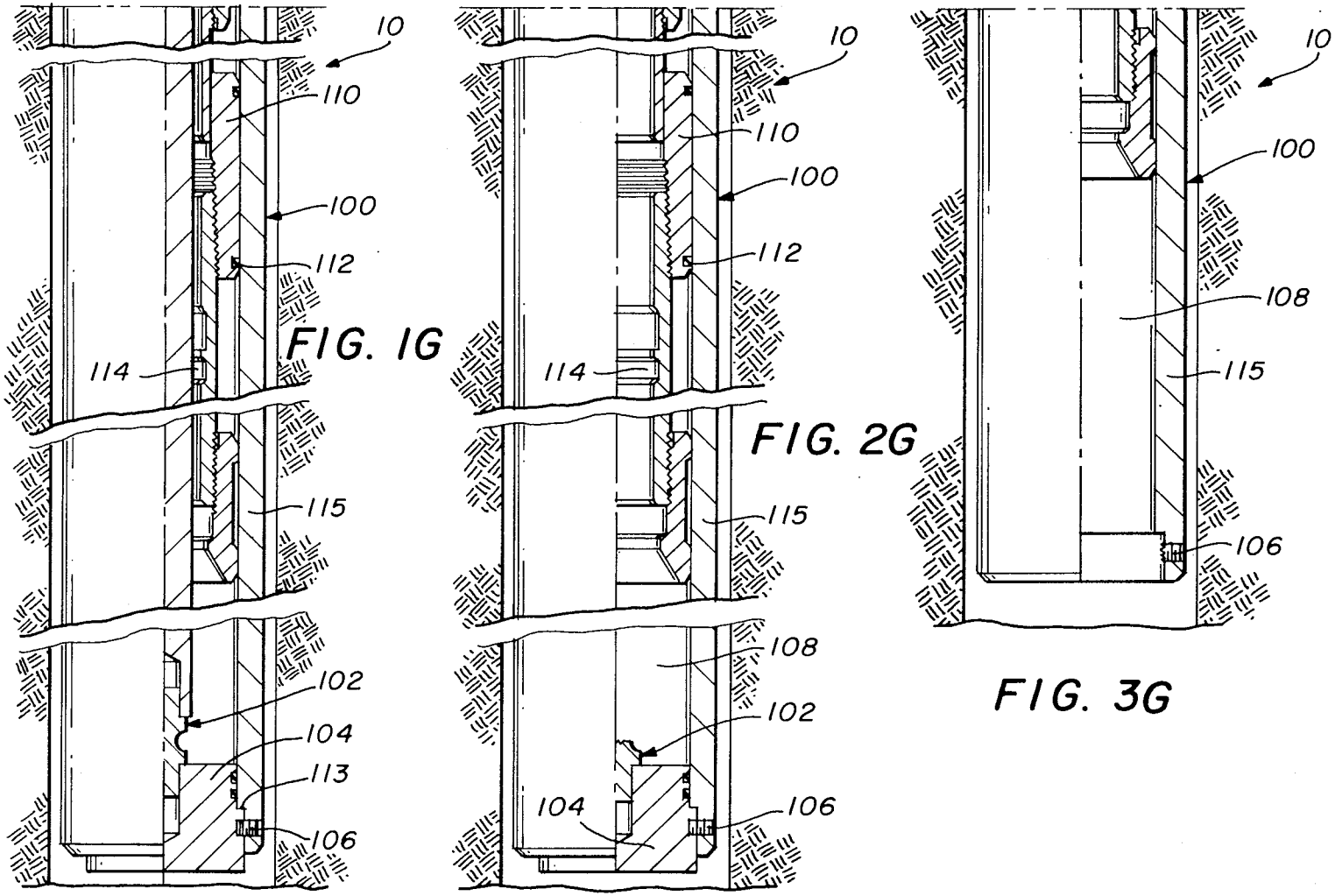

To additionally condition the packer 10 for being lowered into the well on a wireline, friction elements 57 in the reaction member 33 are secured in retraction positions spaced away from in engagement with the well casing by means of frangible pins, 59 as shown in FIG. 1F. As with the other shear screws 51, 53 and 56, these shear pins 59 also are broken as an incident to setting the slip assembly by means of the wireline setting device 44.

Figure 4D:
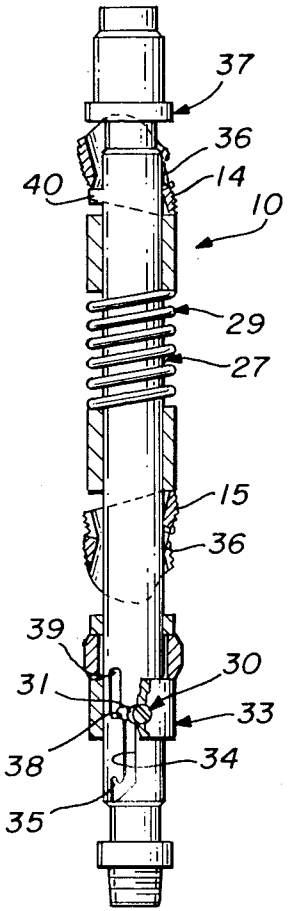
FIGS. 4A through 4D are schematic illustrations of the basic operating principles of the prior art packer, showing the packer being lowered into a well, being set and being released for resetting in another location.
Figure 4C:
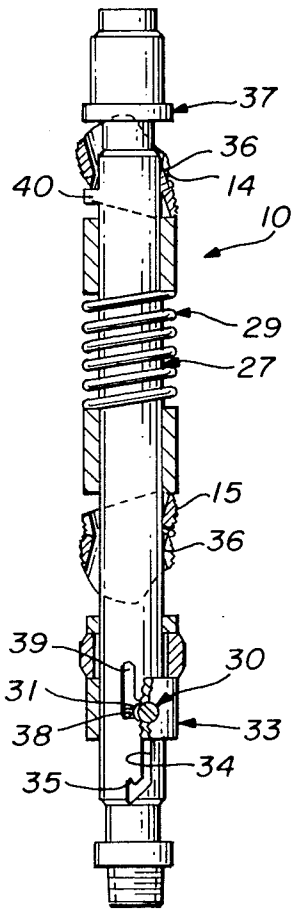
Figure 4B:
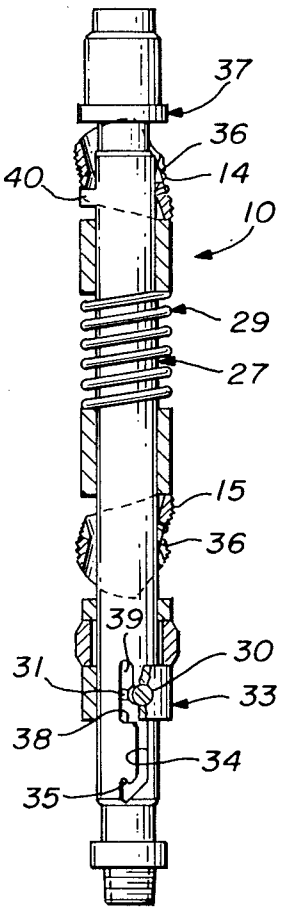
Figure 4A:
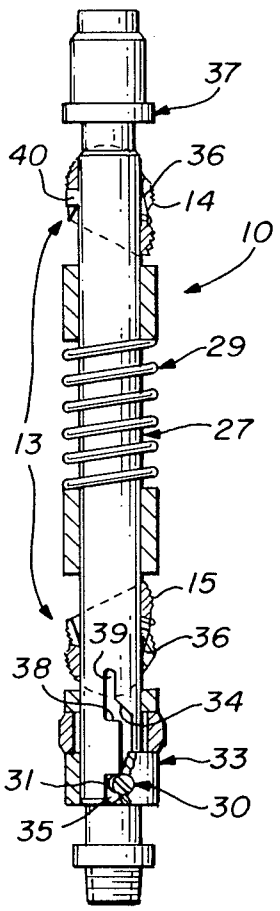

As shown schematically in FIG. 4A, the exemplary well packer 10 includes the basic functional structure of the adaptor 41, the connecting means 30, and the fastener means 43 so that upon actuation of the wireline setting device 44, the adaptor 41 is pulled upwardly and acts through the connecting means to lift the reaction member 33 thereby shearing the fastener means 43 and simultaneously lifting the lower slip element 15 of the bi-directional slip assembly 13 upwardly. At the same time, a force in the other direction acts downwardly on the setting stop means 37 shifting the upper slip element 14 of the bi-directional slip assembly downwardly so as to deform the resilient means 29 between the two slip elements. Once the packer 10 is anchored in the well in the foregoing fashion and the wireline setting mechanism 44 has been retrieved from the well, the condition of the packer is substantially identical to that as is shown schematically in FIG. 4C.

With reference to FIGS. 1A through 1F and to more specifically describe the structure and novel method of the installation of the exemplary well packer 10 the wireline setting device 44 is connected with the lower end portion of the plug assembly 100 and secured thereto by means of the shear stud connector 102. The pump out plug 106 in the lower end portion of the plug assembly 100 includes a radial shoulder 113 abutting a lower shoulder 114 on a tubular member 115 which is connected with the mandrel 27. Accordingly, as a wireline setting plunger 65 is pulled upwardly, force is transmitted through the adaptor 41 to the shear stud 102. In turn, force is transmitted to the reaction member 33 with the latter sliding upwardly on the mandrel 27 and the gudgeon pin 31 following within the J-slot 34.

In the exemplary packer, lower slip element 15 is located within a fixed position relative to the reaction member 33, being mounted by a pin 69 (FIG. 1E) on a tubular sleeve 70 whose lower end is secured within the upper end of the reaction member. The lower slip element 15 thus rides with the reaction member 33 upwardly on the mandrel 27 as the adaptor 41 is lifted by actuation of the wireline setting device 44. As the lower slip element 15 and reaction member 33 are lifted upwardly, the upper end of the sleeve 70 slides upwardly within a lower head 71 of the sealing unit 19 until the slip element 15 contacts the head 71 overcoming the release spring 36 and causing the element to pivot about the pin 69 to shift into an extended position with the teeth of the slip element 15 embedding within the interior surface of the well casing.

As may be seen in FIGS. 1D and 1E, the lower head 71 includes an annular thimble 73 abutting the lower sealing element 20 of the sealing unit. The thimble is mounted to slide upwardly on a support shell 75 so as to deform the seal elements between the lower thimble and an upper thimble 76 of an upper head 77 of the sealing unit.

To provide an oppositely directed force against the sealing unit 19 and to simultaneously set the upper slip element 14, the exemplary packer 10 includes the setting stop means 37 in the form of a slip control housing 79 containing a take up spring 80 mounted above the upper slip element 14. The control housing 79 is fixed to the mandrel 27 with the spring 80 being telescoped into the annular space between the mandrel and the housing above the upper slip element. Extending downwardly out of the housing is a spacer sleeve 81 mounted on the outside of the mandrel 27 with the upper end of the spacer sleeve engaged by the spring 80 and the lower end of the sleeve abutting the tubular slip carrier 55.

The upper slip element 14 is connected to the carrier 55 by means of a pin 83 extending into an elongated slot 84. As previously described, the shear screw 56 secures the upper slip element 14 to the carrier holding the slip initially in a retracted position. Abutting annular shoulders 85 and 86 on the mandrel 27 and carrier 55 (FIG. 1D), respectively, serve to limit downward movement of the spacer sleeve and carrier relative to the mandrel 27. With this structure, it will be appreciated that the upper slip element 14 is located on the mandrel, being resiliently urged into a lowermost position by the spring 80 acting through the spacer sleeve 81, carrier 55 and shoulders 85 and 86. Accordingly, as the sealing unit 19 is urged upwardly by action of the lower slip element 15 against the lower head of the sealing unit, the upper head will abut the upper slip element 14 overcoming the release spring 36 and causing the slip element 14 to pivot outwardly into its extended position for engagement with the interior surface of the well casing.

The spring 80 and housing 79 of the setting stop means 37 thus serve to resiliently position the upper slip element 14 for pivoting into its extended position and setting of the slip assembly. Moreover, it will be appreciated that the takeup spring 80 and the resiliency of sealing unit 19 function, serve together as a spring compression assembly to urge the slip elements into their extended positions when compressed so as to keep the slips set against the well casing.

After the packer 10 is set within the well, the wireline setting device 44 may be removed from the well leaving the packer 10 behind. This exposes the upper end of the packer and its coupling pins 21 for connection to the on/off tool 25 which is connected to tubing string 26. The tubing string 26 may be manipulated to release the packer 10 and move it to a different location within the well as previously described.

As shown in FIGS. 3A through 3F, release of the packer 10 from a set position such as that shown in FIGS. 2A through 2F is achieved by lowering the tubing string 26 with the on/off tool 25 connected to the end thereof to the packer and manipulating the tubing string 26 to latch the on/off tool 25 to the coupling pins 21. When secured, the packer may be released by simply applying torque in a clockwise direction to the tubing string 26 and lifting upwardly.

Thereafter, with the wireline setting device 44 removed, the tubing string 26 of a workover or production rig (not shown) may be attached to the packer 10 for releasing the packer by manipulation of the tubing string 26 and relocation of the packer as may be desired within the well without also having to retrieve the packer for redressing. Advantageously, the foregoing has been achieved through the use of the unique adaptor 41 and frangible connecting means for placing the slip assembly of the packer in an alternate transport condition enabling the slip assembly to be set by means of the wireline setting device.

What is claimed is:

1. In a well packer having a tubular mandrel extending therethrough adaptable for connection to a tubing string for manipulation of the tubing string to shift a slip assembly between setting and transport conditions relative to resilient means for setting, unsetting and resetting of the slip assembly against the casing in a well without the necessity of pulling the tubing string from the well, the slip assembly including a reaction member with a friction element engageable with the well casing for reaction forces to be transmitted between the packer and the tubing string upon manipulation of the tubing string, the improvement comprising:

an adapter extending through said mandrel with one end connectable to a wireline setting device and an opposite end frangibly connected to said slip assembly for first setting a slip assembly with the wireline setting device, the slip assembly being releasably supported in an alternate transport condition relative to said resilient means for said first setting of the slip assembly;

means for releasing the friction element as an incident to said first setting of the slip assembly;

said packer also having the tubular mandrel supporting the slip assembly and reaction member therein, said adapter being supported in telescoping relationship with said mandrel and having a frangible portion on said adapter connected to a pump-out plug releasably located in said packer closing said tubular mandrel; and means mounted in said mandrel for retaining said plug in said packer for preventing said plug from being dislodged from said packer until the application of a predetermined pressure in said mandrel after parting said frangible portion during the initial setting of said packer.

2. In the packer as set forth in claim 1 wherein said means for releasably supporting the slip assembly in said alternate transport condition comprises a first frangible pin extending between said slip assembly and said mandrel, and said means for releasing the friction element comprises a second frangible pin extending between said reaction member and said mandrel.

3. In the packer as set forth in claim 2 wherein said resilient means includes a sealing unit mounted on said mandrel and coacting with said slip assembly when set to seal against the well casing, the improvement further comprising said means releasably supporting said slip in said alternate transport condition including frangible connecting means between said sealing unit and said mandrel for supporting said unit in an initial travel position on said mandrel, said connecting means being broken as an incident to said first setting of the slip assembly.

4. In the packer as set forth in claim 3, with the slip assembly including a pair of slip elements for supporting said sealing unit in sealing engagement with the well casing, wherein the improvement further comprises a shear screw securing one of said pair of slip elements initially in a travel position relative to said sealing unit, said shear screw being broken as an incident to said first setting of the slip assembly to release said one of said pair of elements for movement into a setting position embedding in the well casing.

5. A well packer for use within the casing of a well including:

a tubular mandrel;

bi-directional slip assembly supported on said mandrel, said mandrel being manipulatable through setting and release sequences to shift relative to said slip assembly causing said assembly to move between extended and retracted positions to grip and release the well casing, respectively, at a downhole location in the well;

spring compression assembly on said mandrel movable between generally relaxed and compressed conditions for urging said slip assembly into said extended position when in said generally compressed condition;

slip disengaging means for retracting said slip assembly from said extended position to said retracted position during said release sequence;

setting stop means connected to said mandrel for engagement with said slip assembly to limit relative movement between said mandrel and said assembly at least initially in said setting sequence;

a reaction member carried on said mandrel and connectable with the well casing for support therefrom enabling relative movement between said member and said mandrel during said sequences;

connecting means between said reaction member and said mandrel for supporting said reaction member selectively on said mandrel in transport and setting conditions;

a pump-out plug located to close said mandrel and releaseably connected to said packer whereby a predetermined pressure in said mandrel dislodges said pump-out plug;

an adapter extending through said mandrel with one end connectable to a wireline setting device and an opposite end frangibly connecting to said pump-out plug for a first setting of said slip assembly with the wireline setting device whereupon said opposite end parts; and said slip assembly being supported temporarily in an alternate transport condition relative to said mandrel when first lowering the packer in the well prior to actuation of said wireline setting device.

6. In a method for setting, unsetting and resetting a packer against the casing in a well by manipulation of a tubing string, the improvement comprising the steps of first setting the slip assembly downhole in the well using a wireline setting device and, thereafter, connecting the tubing string to the packer as set downhole in the well, unsetting the slip assembly by manipulation of the tubing string, resetting the slip assembly by manipulation of the tubing string and without necessarily pulling the tubing string and packer from the well, and applying pressure through the tubing string to open the bore through said packer.

7. In a method for setting, unsetting and resetting the slip assembly of a packer against the casing in a well by manipulation of a tubing string, the improvement comprising the steps of attaching a wireline setting device to the packer, lowering the packer by wireline into the well to a selected position, actuating the wireline setting device for a first setting of the slip assembly in the well, detaching the wireline from the packer while leaving the slip assembly set, retrieving the wireline from the well, connecting a tubing string to the packer for manipulation of the tubing string unsetting the slip assembly by manipulation of the tubing string, resetting the slip assembly without the necessity of pulling the packer from the well for redressing prior to being reset, thereafter applying pressure through the tubing string to open the bore through said packer.

8. The method as set forth in claim 7 wherein said packer includes locator means supporting a reaction member and connecting with the slip assembly on a mandrel for shifting the latter between transport and setting conditions relative to the slip assembly, said method including the additional steps of releasably supporting said reaction member in an alternate condition for lowering of the packer by wireline into the well, releasing the reaction member from said alternate transport condition and shifting of the reaction member from said alternate transport condition into its setting condition as an incident to said first setting of the slip assembly.

9. The method as set forth in claim 8 wherein the reaction member of the packer includes a friction element engageable with the well casing whereby reaction forces may be transmitted between the packer and the tubing string during manipulation thereof for shifting of the reaction member between its transport and setting conditions, said method including the additional steps of releasably securing the friction element in a retracted position away from engagement with said casing prior to said first setting of the slip assembly, and releasing the friction element to engage the casing prior to resetting of the slip assembly.

10. The method as set forth in claim 9 wherein said step of releasing the friction element occurs as an incident to said first setting of the slip assembly.

11. The method as set forth in claim 8 wherein said packer includes a sealing unit mounted on said mandrel for sealing against the casing in the well when the slip assembly is set, said method including the additional steps of releasably supporting the sealing unit in an initial travel position for lowering of the packer by wireline into the well, freeing the sealing unit to coact with the slip assembly to seal against the casing during said first setting of the slip assembly, repositioning the sealing unit in a subsequent travel position during subsequent unsetting of the slip assembly by manipulation of the tubing string.

12. The method as set forth in claim 11 wherein the slip assembly of the packer includes a pair of slip elements for supporting the sealing unit in sealing engagement with the well casing, said method including the additional steps of releasably connecting one of said pair of slip elements in an initial travel position relative to the sealing unit, disconnecting said one of said slip elements when first setting the slip assembly, and repositioning the one slip element in a subsequent travel position relative to said sealing unit when unsetting the slip assembly by manipulation of the tubing string.

* * * * *